United States Patent [19]

Kishi

[11] 4,433,495

[45] Feb. 28, 1984

[54] DIGGER WITH SUPPORTING BASE PIVOTABLE ON TRANSVERSIBLE MEMBER

[76] Inventor: Mitsuhiro Kishi, 1320 Mizuhohocho,, Ashikaga-shi, Tochigi-Pref. 326-03, Japan

[21] Appl. No.: 342,998

[22] Filed: Jan. 27, 1982

[30] Foreign Application Priority Data

| | | | |
|---|---|---|---|
| Jan. 31, 1981 | [JP] | Japan | 56-13114 |
| Jan. 31, 1981 | [JP] | Japan | 56-13115 |
| Jan. 31, 1981 | [JP] | Japan | 56-13116 |
| Jan. 31, 1981 | [JP] | Japan | 56-13117 |
| Jan. 31, 1981 | [JP] | Japan | 56-13113 |
| Mar. 20, 1981 | [JP] | Japan | 56-41288 |

[51] Int. Cl.[3] ..... E02F 5/02

[52] U.S. Cl. ..... 37/103; 414/694

[58] Field of Search ..... 37/103, 117.5; 414/685, 414/687, 688, 694, 695, 695.5, 695.8, 705, 711, 722, 723

[56] References Cited

U.S. PATENT DOCUMENTS

| | | | |
|---|---|---|---|
| 3,247,986 | 4/1966 | Eyler et al. | 414/694 |
| 3,575,307 | 4/1971 | Gunot | 414/694 |
| 3,606,047 | 9/1971 | Schaeff | 414/694 |
| 3,664,528 | 5/1972 | Gauchet | 414/694 |
| 4,183,711 | 1/1980 | Schaeff | 414/687 |

FOREIGN PATENT DOCUMENTS

| | | | |
|---|---|---|---|
| 2612879 | 9/1977 | Fed. Rep. of Germany | 414/694 |
| 55-45956 | 3/1980 | Japan | 37/103 |
| 971028 | 9/1964 | United Kingdom | 414/695.5 |
| 1006638 | 10/1965 | United Kingdom | 414/694 |

*Primary Examiner*—S. H. Eickholt

*Attorney, Agent, or Firm*—Martin A. Farber

[57] ABSTRACT

A digger comprises a carrier with wheels and trestles, the carrier having a stage, a transversible member disposed to the stage, a supporting base pivoted to the transversible member, and means for operating a digging-up mechanism with a bucket crane supported to the supporting base.

20 Claims, 17 Drawing Figures

DIGGER WITH SUPPORTING BASE PIVOTABLE ON TRANSVERSIBLE MEMBER

BACKGROUND OF THE INVENTION

The present invention relates to a digger with a bucket crane, and more particularly to a digger with a bucket crane turnable on a digger carrier.

The prior digger usually comprises a carrier 1 with a stage, and a base 2 for supporting a bucket crane 3, the base 2 directly pivoted to the stage at a center position 4. Accordingly, under road construction, the bucket crane 3 is turned is turned behind the carrier 4 through one side way 5 of a subject road opposite to the work area 6 as shown in FIG. 1, so as to transport soil and sand to a truck 7 driving belong the carrier 1 with progress of the digging operation, whereby the traffic should be occasionally controlled so as to stop vehicles on the opposite way 5 in order to avoid clash danger to the bucket crane.

The other prior digger has already been proposed so as to transport soil and sand with bucket crane, without passing through the opposite way of the road, from the front of the carrier to the back thereof. Demerit of the mechanism is a point that a digger cannot be dug to the road side with it being disposed on the road way.

SUMMARY OF THE INVENTION

An object of the present invention is to provide a digger which can be operated to transport soil and sand from the front of a carrier to the back thereof without blocking traffic on one side way of a subject road opposite to the road construction.

Another object of the present invention is to provide a digger which can dig the side of a road with it being disposed on the rod.

The other objects and features of the present invention will be apparently described with reference to accompanying drawings.

DETAILED DESCRIPTION OF THE PRESENT INVENTION

Figure 1:
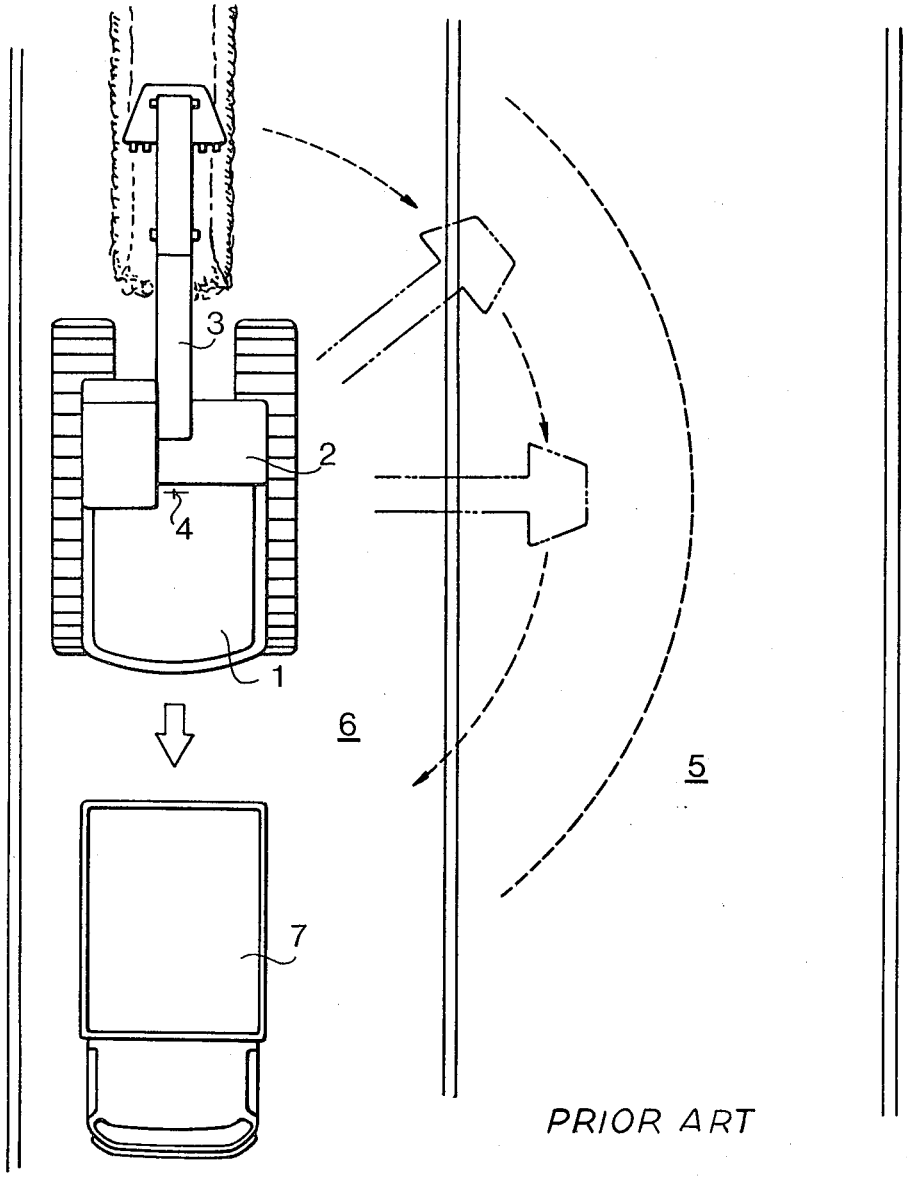
FIG. 1 is a diagrammatic plan view of the prior art digger already indicated to this text for comparison with that of this invention.

Referring to FIGS. 2 to 6, there is provided a digger of this invention which comprises a carrier 11 with four wheels 12 juxtaposed to both sides of the carrier 11, the carrier 11 having a stage 13 formed on the upper portion so as to have a flat surface and four trestles 14 for fixedly supporting the carrier 11 on the earth; a transversible member 15 disposed on the stage 13; a supporting base 16 pivoted to the transversible member 15 about a perpendicular axis; and means 17 for operating a digger mechanism 18 with a bucket crane 19.

On the stage 13 a circular rail 20 is mounted for guiding the transversible member 15, the center of the circular pitch of rail in this embodiment being defined to the center of the rotation of the transversible member 15 pivoted to the stage 13.

The transversible member 15 includes a plurality of bearings 15*a* moving along the guide rail 20, and a trunnion 15*b* rotatably inserted into a circular gear 21 fixedly disposed on the stage 13.

Figure 6:
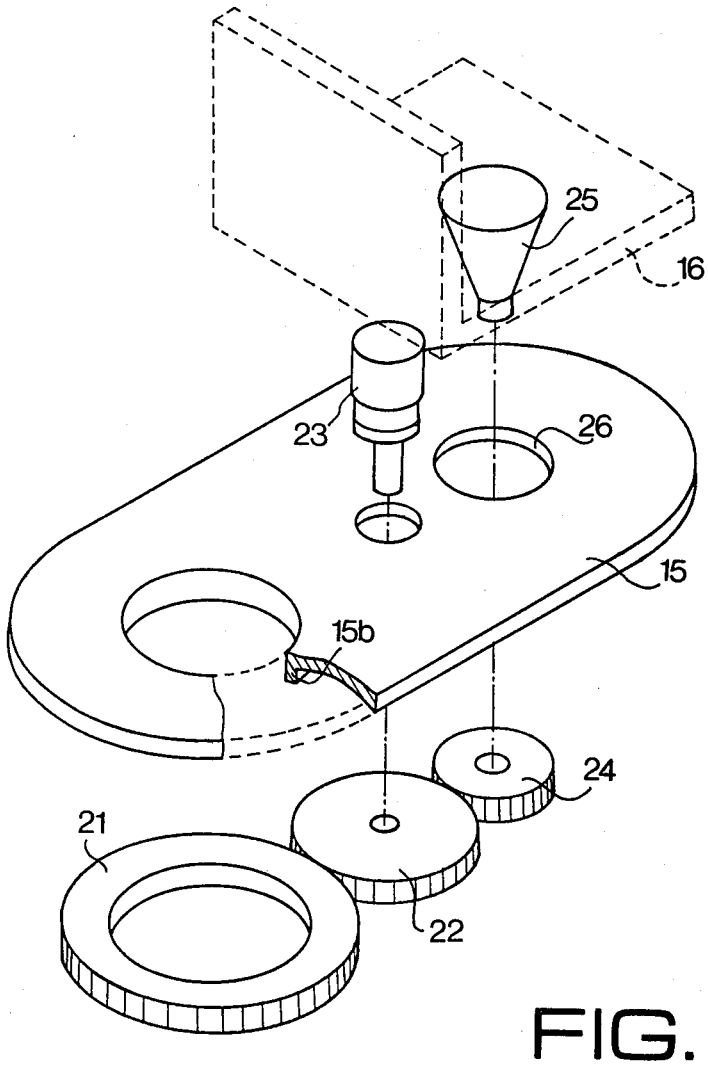
FIG. 6 is a perspective view of essential parts of this invention which are illustrated in demounted condition.

The essential parts of this invention are indicated in FIG. 6 in detail, i.e., there are provided a gear 22 rotatably supported on the transversible member 15 and intermeshed or engaged with the gear 21, a driving motor 23 operatively connected to the gear 22 and attached to the transversible member 15, a gear 24 intermeshed or engaged with the gear 22, and a conical bearing 25 rotatably supported in a bearing hole 26 formed in the transversible member 15, the conical bearing 25 being attached to the supporting base 16 and adapted to secure the gear 24 to the bottom axial end thereof.

The bucket crane 19 comprises, as already well known, a supporting block 19*a* with a hinge member 19*b* mounted on the suporting base 16, a first beam 19*c* one end of which is pivoted to the hinge member 19*b*, a second beam 19*d* one end of which is pivoted to the other end of the beam 19*c*, a bucket 19*e* pivoted to the other end of the beam 19*d*, piston cylinder assemblies 19*f*, 19*g* and 19*h* actuated by oil pressure and interposed between the hinge member 19*b* and beam 19*c*, the beams 19*c* and 19*d*, the beam 19*d* and bucket 19*e*, respectively.

In this embodiment, the gear ratio of the gears 21, 22 and 24 should be suitably selected, for example, as 134, 90, 53 teeth. Therefore, the transversible member 15 can be turned along the rail 20 and the supporting base 16 can also be turned in the opposite rotating direction when the motor 23 is driven.

Figure 2:
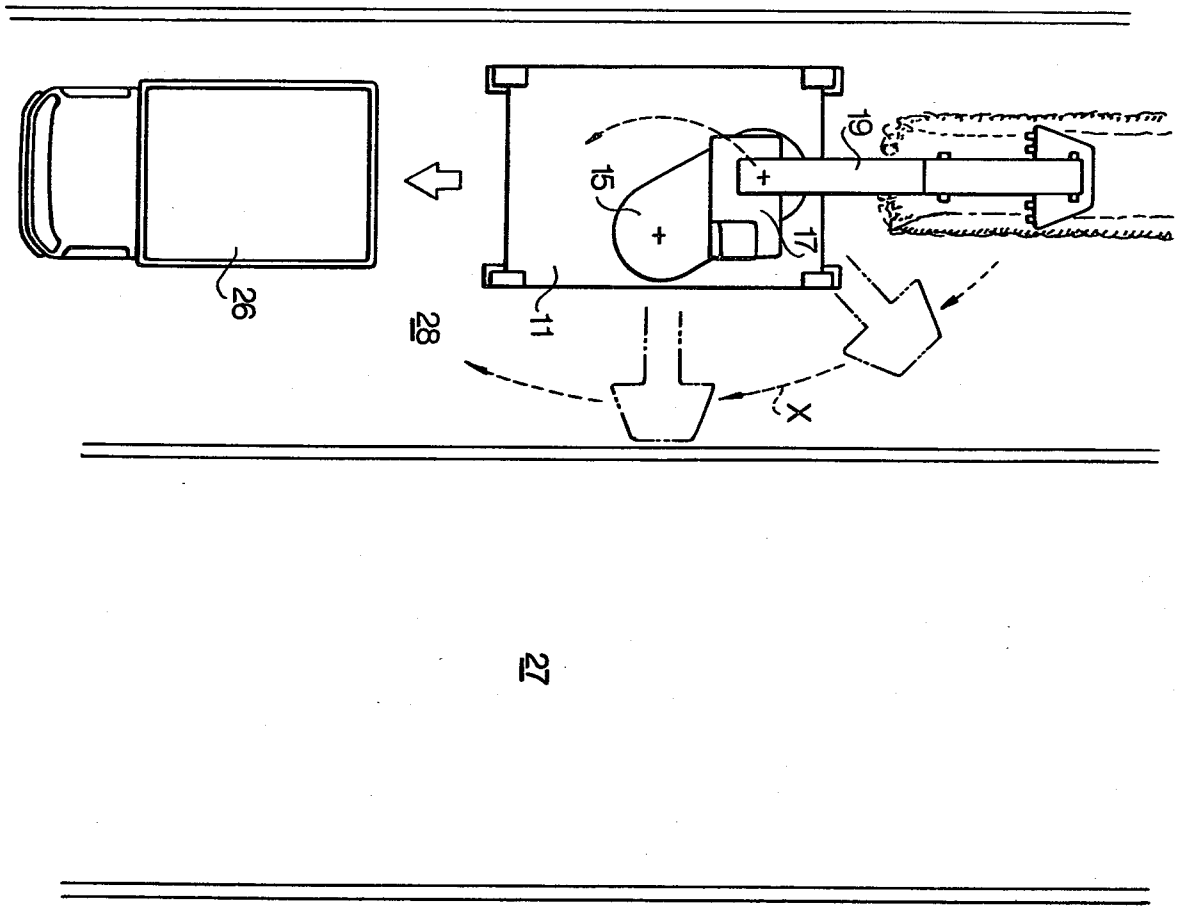
FIG. 2 is a diagrammatic plan view of a digger of this invention illustrated as transport soil and sand with a bucket.
Figure 3:
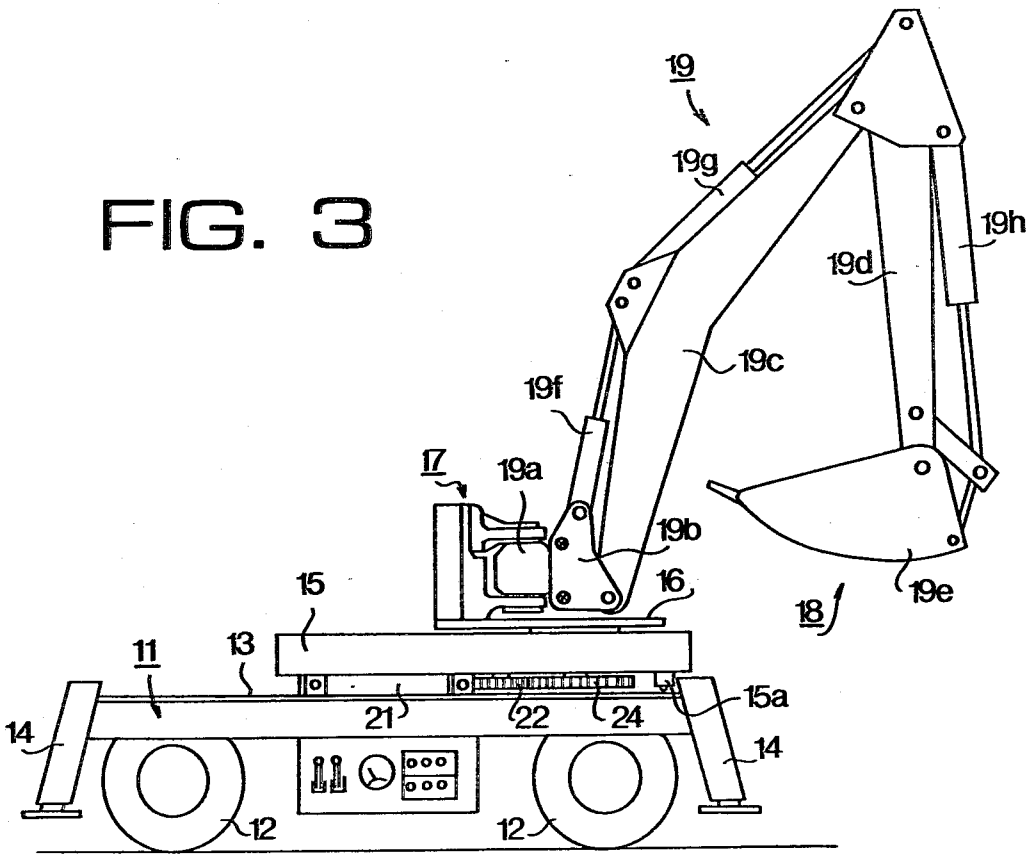
FIG. 3 is a side view of the digger of FIG. 2 illustrated in detail.
Figure 4:
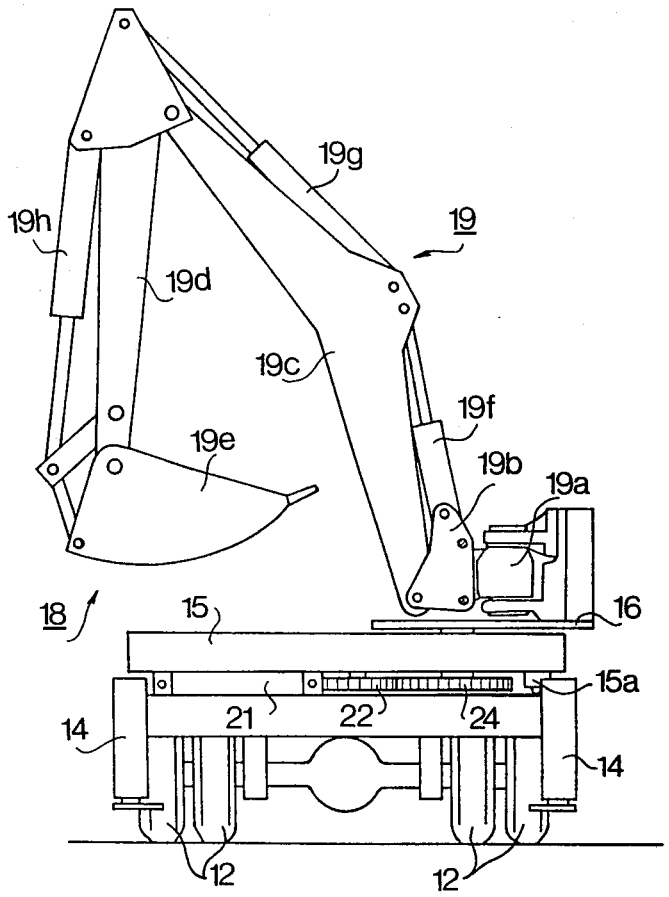
FIG. 4 is a front view of the digger of FIG. 2 illustrated in detail but with the bucket shown in a side position.
Figure 5:
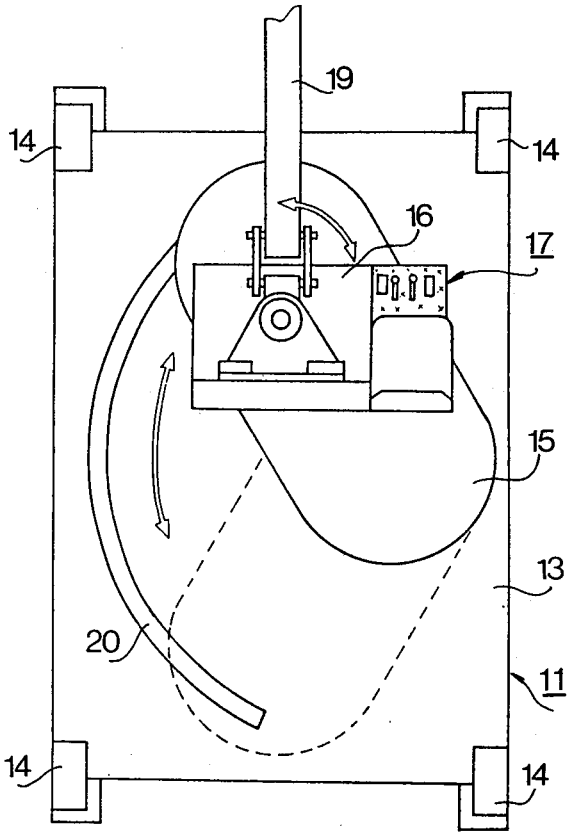
FIG. 5 is a plan view of the digger of FIG. 2 illustrated in detail.

Accordingly, when the soil and sand is carried by crane 19 from the front of the carrier 11 to the back of the carrier 11 and to a truck 26, the bucket 19*e* travels along a track x, for example, formed to an oval orbit. The track x is indicated on the carrier 11 or near to the outside of the carrier 11 as shown in FIG. 2, thereby not to prevent the traffic on one side way 27 of the subject road, when the road construction is progressed on the opposite side way 28.

Figure 7:
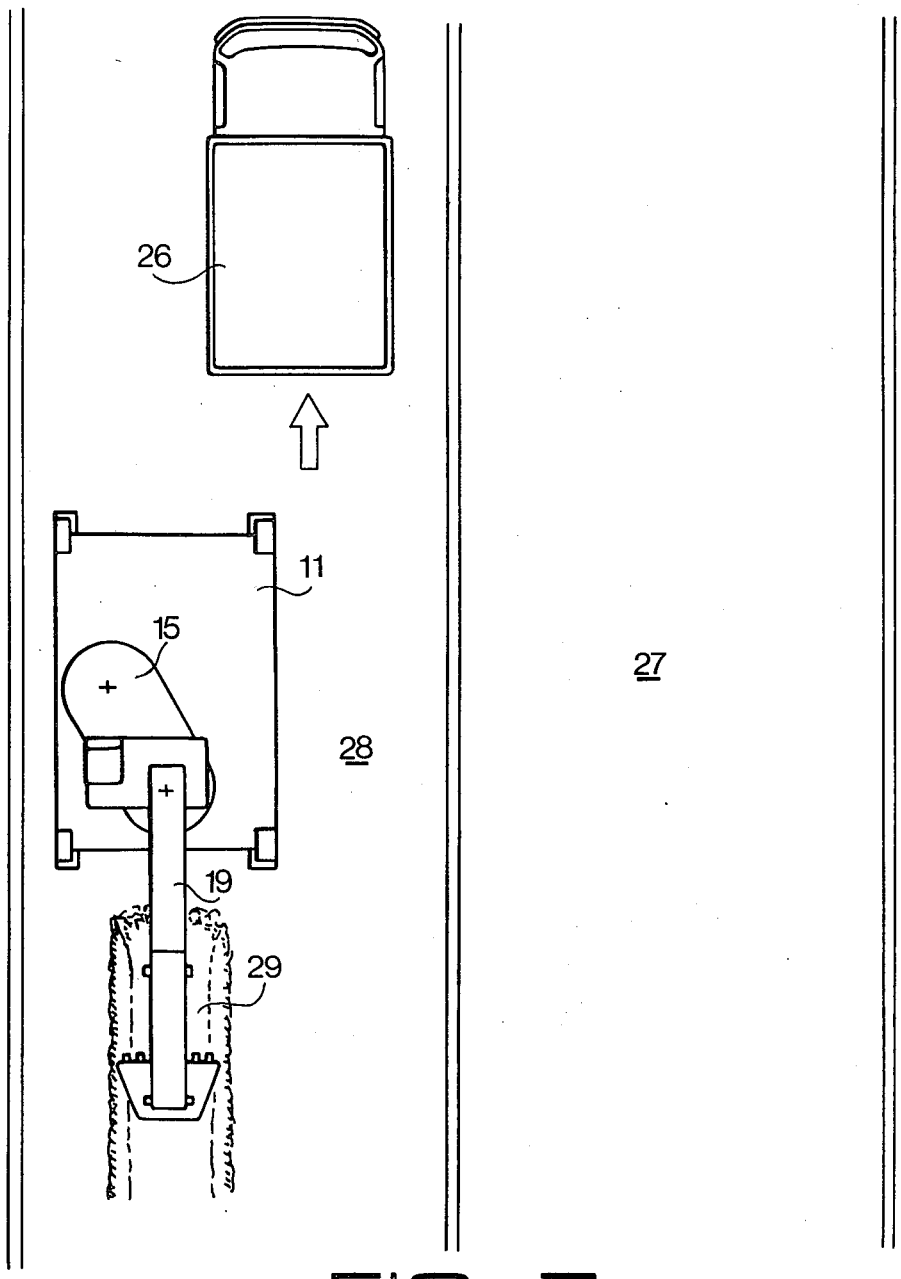
FIG. 7 is a diagrammatic plan view of a digger of this invention digging the road side.

If the digger of this invention is operated to dig the road side portion 29, the transversible member 15 may be maintained to the suitable position of the stage 13 as shown in FIG. 7.

Figure 8:
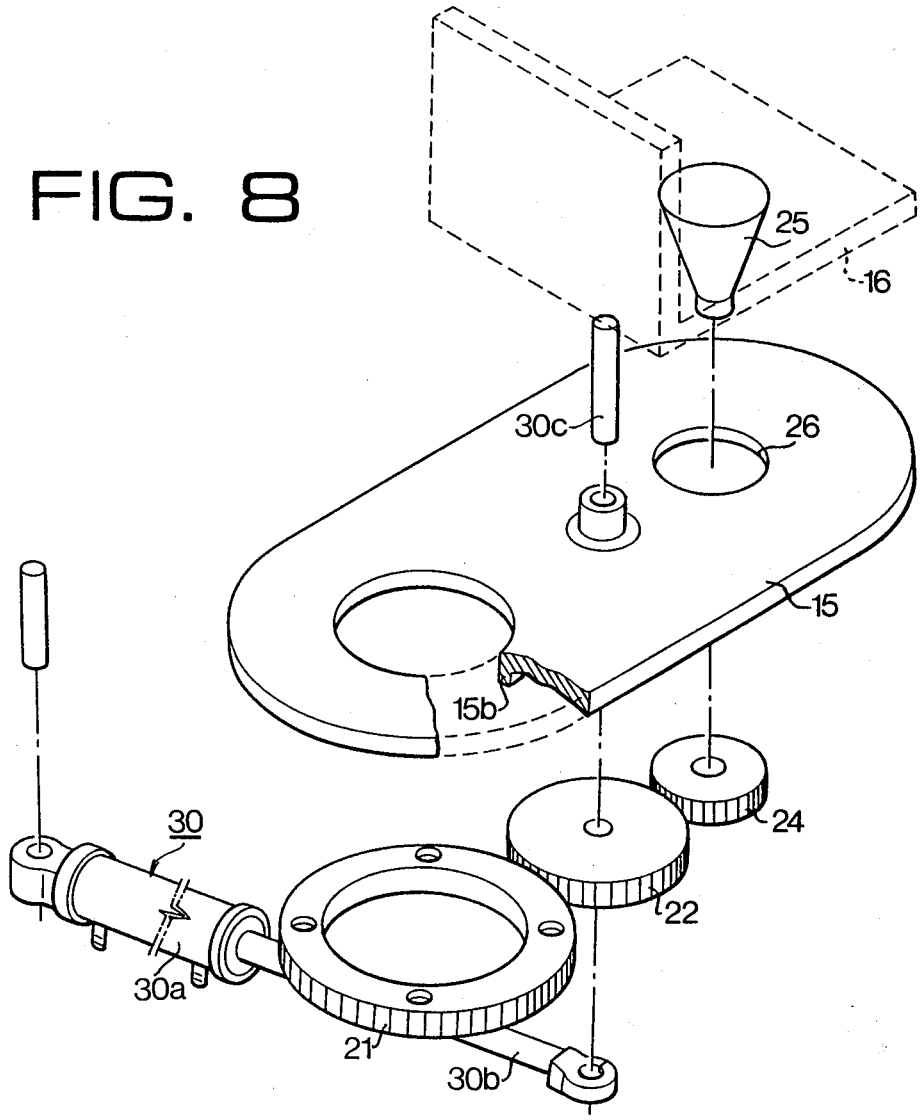
FIG. 8 is a perspective view of essential parts of another embodiment of this invention.

In another embodiment as shown in FIG. 8, the gear 22 is driven by means of a piston cylinder assembly 30 which comprises a cylinder 30*a* supplied with oil pressure, and a piston rod 30*b* connected to a piston (not shown) inserted to the cylinder 30*a*, the end of the cylinder 30*a* being pivoted to the carrier 11 and the end of the rod 30*b* rotatably supporting the axial shaft 30*c* fixedly secured to the gear 22, whereby the gear 22 can be rotated and turned to the periphery of the gear 21.

Figure 9:
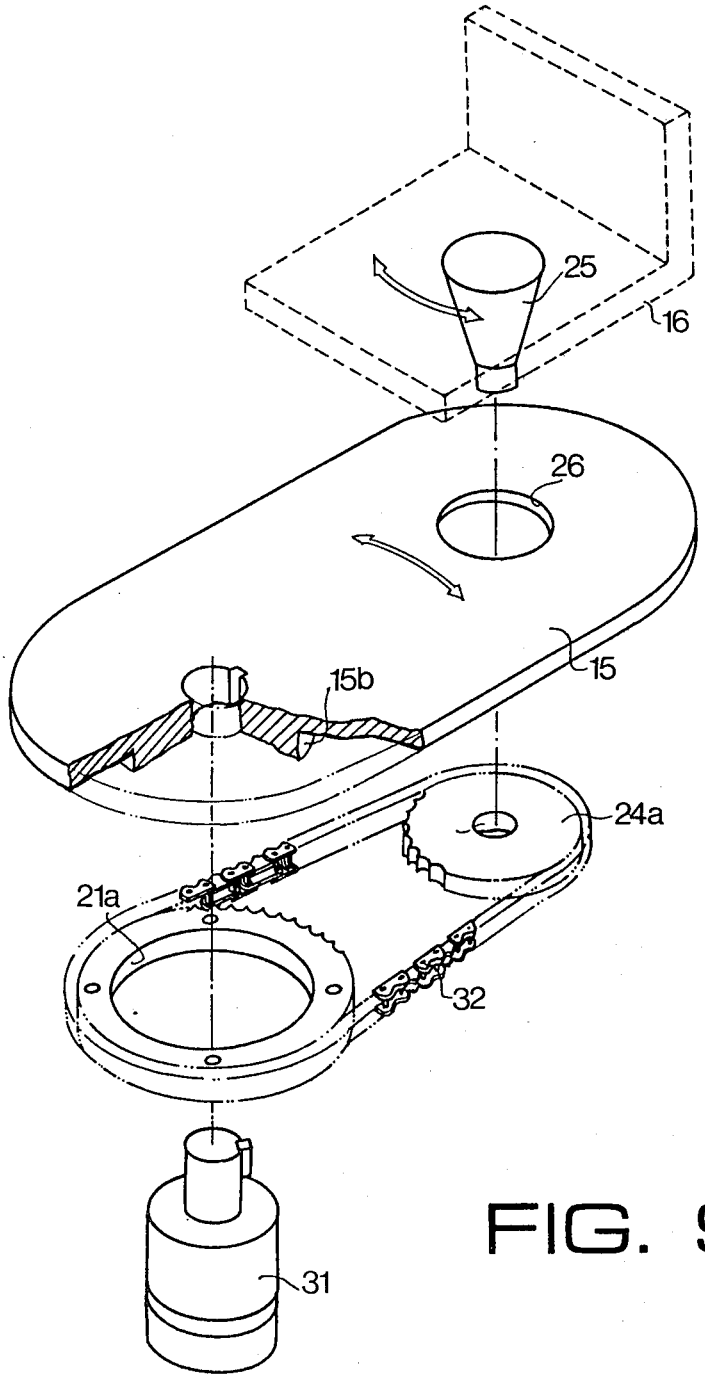
FIG. 9 is a perspective view of essential parts of the this embodiment of this invention.

In the third embodiment as shown in FIG. 9, the transversible member 15 is driven by means of a driving motor 31, the gears 21 and 24 are exchanged to sprockets 21*a* and 24*a* between which an endless chain 32 is stretchedly wound, and the gear 22 is eliminated.

Accordingly, when the motor 31 is driven, the transversible member 15 is turned to a rotating direction and the supporting base 16 is rotated to an opposite direction via the sprocket-chain assembly mentioned above.

Figure 10:
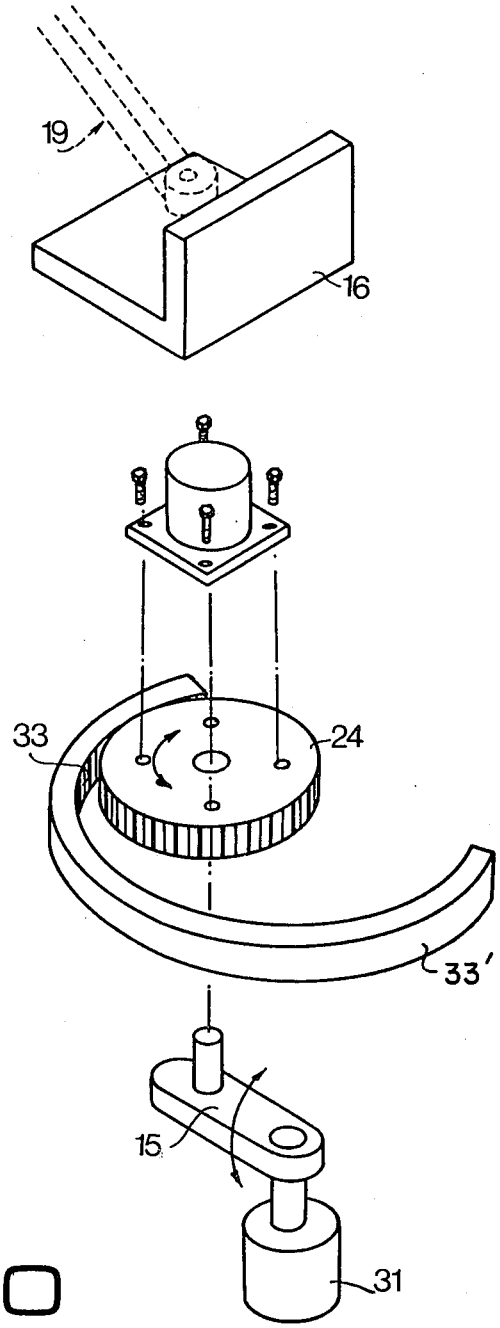
FIG. 10 is a perspective view of essential parts of the fourth embodiment of this invention.
Figure 11:
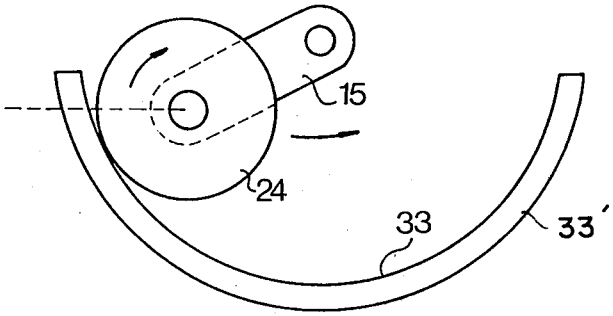
FIGS. 11(*a*) to FIG. 11(*c*) are plan views of the essential parts of FIG. 10.
Figure 11:
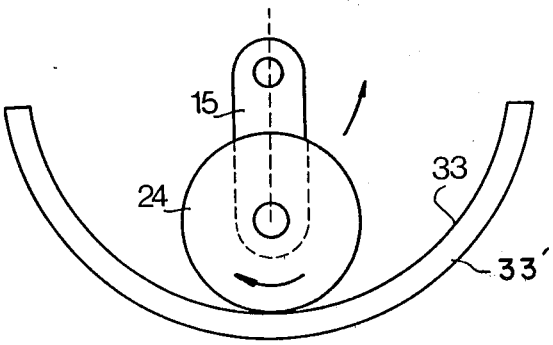
Figure 11:
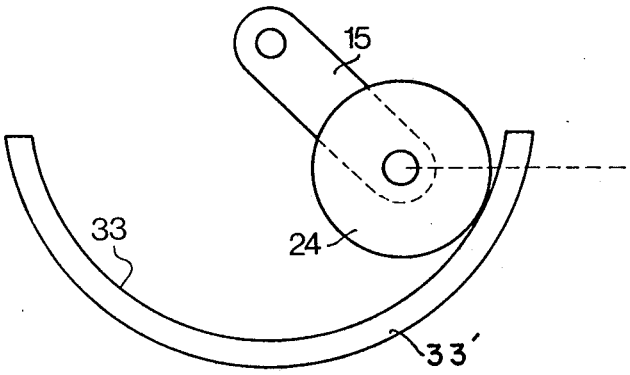

In the fourth embodiment as shown in FIGS. 10 and 11(*a*) to (*c*), the transversible member 15 is driven by means of the same driving motor 31 as that of the third embodiment, the gear 24 is free from the driving of the motor 31, the gear 24 being intermeshed with an internal gear 33 which is formed to the inside wall of the guide rail 33', and the gears 21 and 22 are eliminated. Accordingly, when the motor 31 is driven the transversible member 15 is turned to a rotating direction and the supporting base 16 is rotated to an opposite direction with the gear 24 being rotated along the guide rail 20 by gear-intermeshing.

Figure 12:
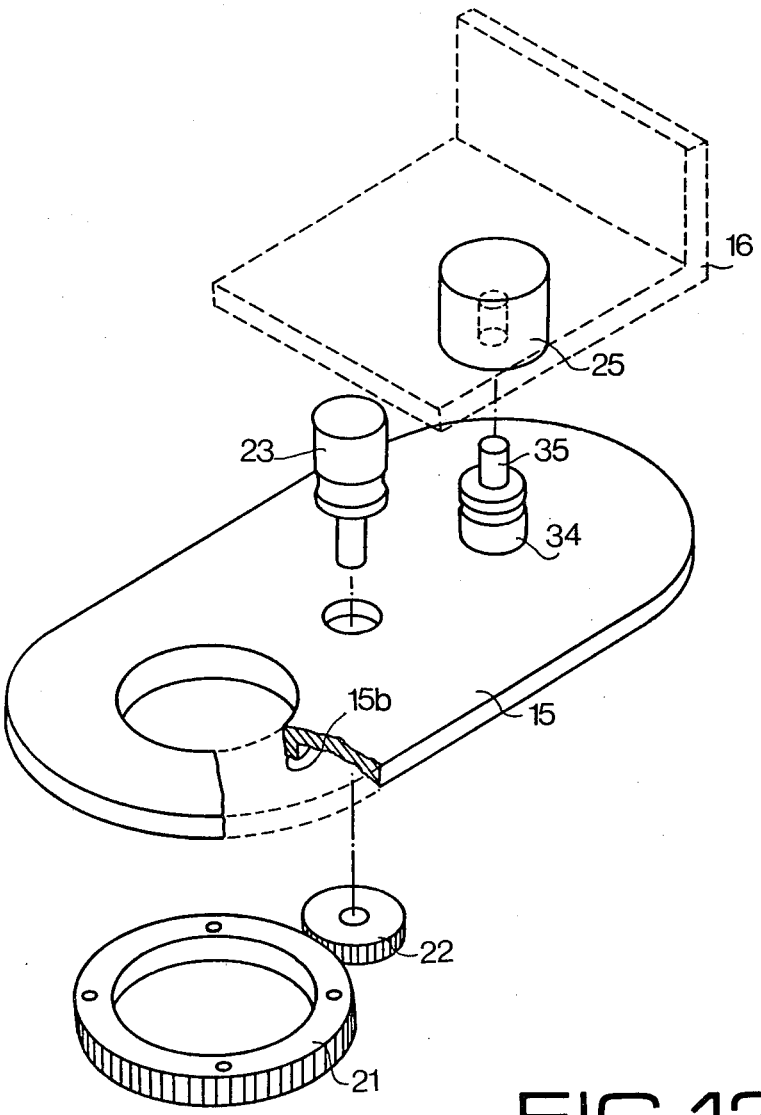
FIG. 12 is a perspective view of essential parts of the fifth embodiment of this invention.
Figure 13:
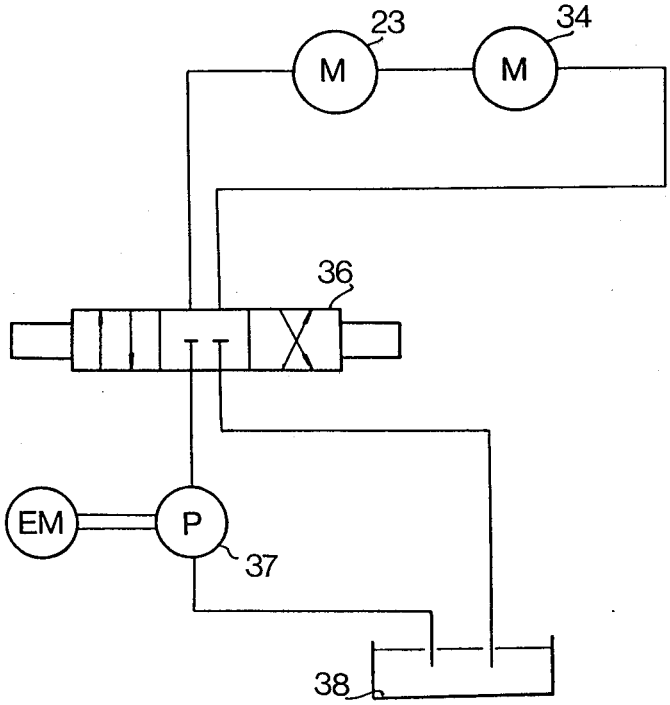
FIG. 13 is a circuit of an oil-pressure control system for essential parts of FIG. 12.

In the fifth embodiment as shown in FIGS. 12 and 13, the essential parts of this embodiment almost are the same as that of the first embodiment except the fact that the gear 24 is eliminated and the supporting base 16 is driven by means of a separate motor 34. In this case, the motor 23 for driving the gear 22 and motor 34 for driving a pivot 35 formed to the bottom of the supporting base 16 are gear-pumping motors which are controlled for driving and stopping by means of spool valve 36. In order to supply oil pressure to the motors, there are provided a pump 37 having an engine which is usually used to running of the carrier 11, as well as an oil tank 38.

Figure 14:
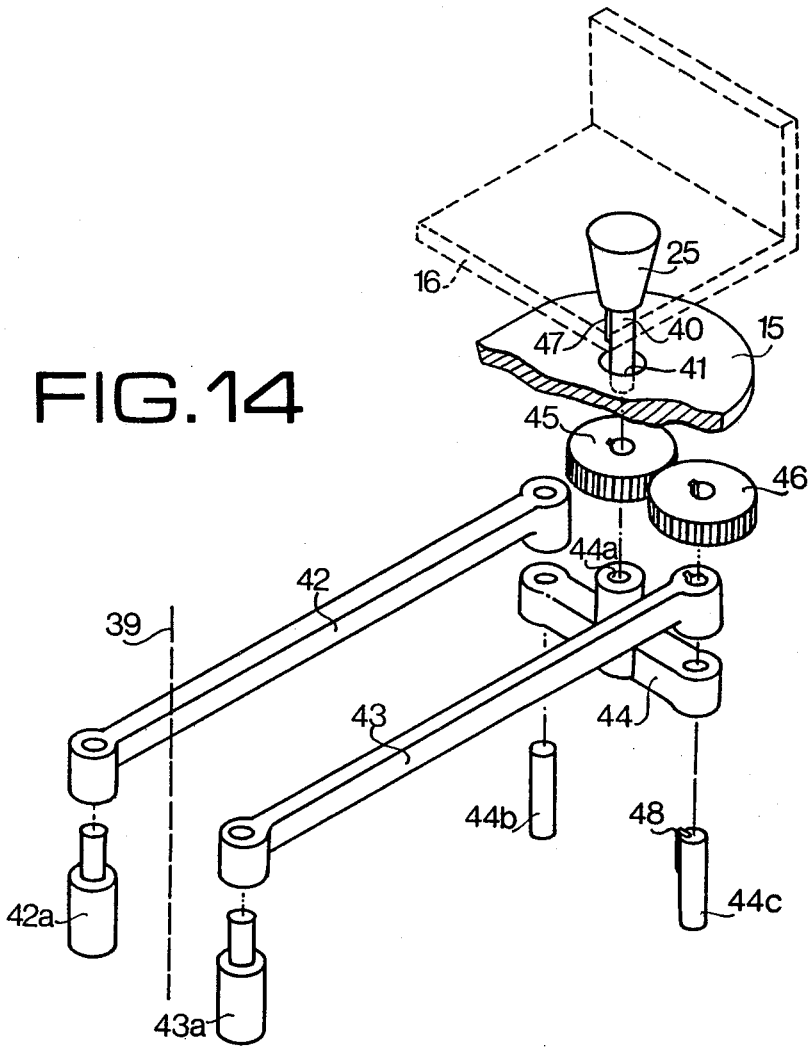
FIG. 14 is a perspective view of essential parts of the sixth embodiment of this invention.
Figure 15:
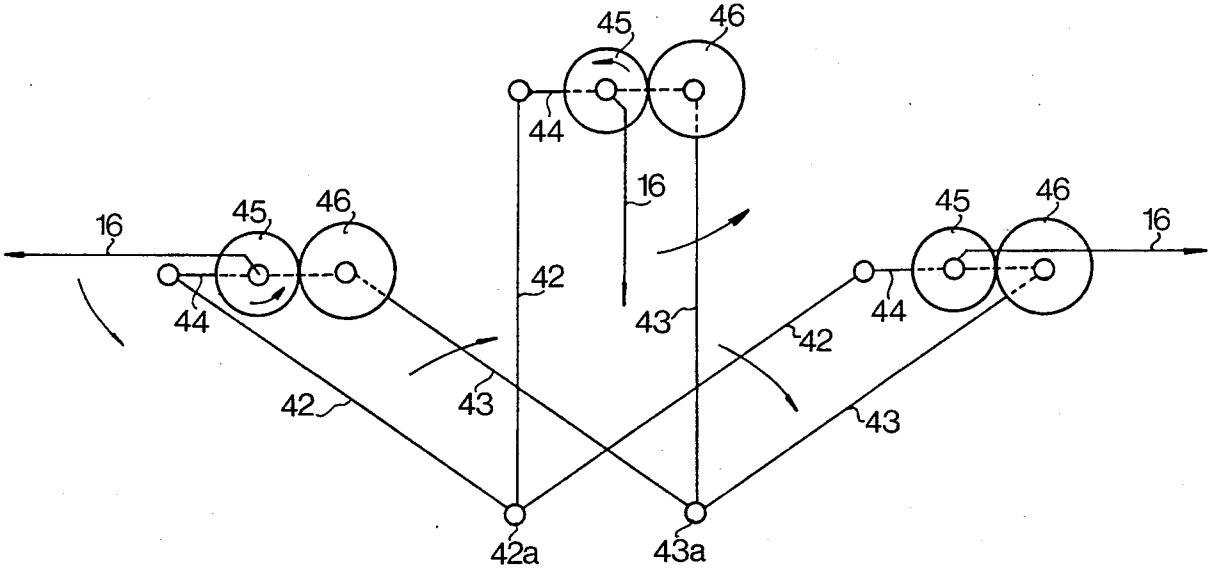
FIG. 15 is a diagrammatic construction of a control mechanism for essential parts of FIG. 14.

In the sixth embodiment as shown in FIGS. 14 and 15, the transversible member 15 has a pivot 39 driven by means of a motor (not shown) as shown in the third embodiment, and the supporting base 16 has a pivot 40 rotatably supported to a bearing hole 41 formed to the transversible member 15. The other parts of the essential parts of this invention consist of a pair of link rods 42 and 43 pivoted by pins 42*a* and 43*a* to prescribed positions spaced by identified distances from the pivot 39 in a front-rear direction of the carrier 11, a joint member 44 having a bearing hole 44*a* to rotatably support the pivot 40 and both ends pivoted by pins 44*b* and 44*c* which are spaced to the pivot 40 by the same distances as these of pins 42*a* and 43*a*, and a pair of intermeshing gears 45 and 46 which are engaged with the pivot 40 and pin 44*c* by means of keys 47 and 48, respectively.

Accordingly, when the transversible member 15 is turned for a suitable angle, the link rods 42 and 43 as well as the gears 45 and 46 act as the supporting base 16 is turned for the same angle as that of the transversible member 15 and having an opposite direction thereto, thereby to substantially transport the bucket 19*e* across the higher of the carrier 11 in a longitudinal direction as shown in FIG. 15.

What is claimed is:

1. A digger comprising:

a carrier having a stage thereon and supporting wheels and trestles, a transversible member angularly movably mounted on said stage, a supporting base angularly movably mounted on said transversible member, a digging-up mechanism including a bucket crane operatively supported on said supporting base, and means on said transversible member for rotating said digging-up mechanism about a first axis thereof in response to angular movement of said transversible member about a second axis thereof.

2. The digger according to claim 1, wherein:

said means comprises means for turning said supporting base in a direction opposite to that of the angular movement of said transversible member in response thereto.

3. The digger according to claim 2, wherein:

said turning means comprises a motor mounted on said transversible member, and means comprising a gear train for transmitting rotation of said motor to said transversible member and said supporting base.

4. The digger according to claim 3, wherein:

said gear train comprises a first gear fixedly disposed on said stage and coaxial with said second axis, said transversible member being pivotally mounted on said first gear, a second gear operatively coupled to said motor and meshing with said first gear, and a third gear connected to said supporting base in coaxial relation to said first axis and meshing with said second gear, said third gear being operatively coupled to said supporting base.

5. The digger according to claim 4, wherein:

said transversible member has an annular trunnion coaxial with said second axis, and said first gear comprises an annular gear, said annular trunnion is rotatably inserted inside said first gear.

6. The digger according to claim 1, wherein:

said transversible member comprises an oblong plate having rounded end portions with said first and second axes located thereon respectively at said end portions.

7. The digger according to claim 6, wherein:

said means comprises:

a motor mounted on said transversible member substantially intermediately between said rounded end points, a first gear fixedly disposed on said stage and coaxial with said second axis, said transversible member being pivotally mounted on said first gear, a second gear operatively coupled to said motor and meshing with said first gear, and a third gear connected to said supporting base in coaxial relation to said first axis and meshing with said second gear, said third gear being operatively coupled to said supporting base.

8. The digger according to claim 7, wherein:

said first, second and third gears have parallel axes and are arranged substantially coplanar.

9. The digger according to claim 8, further comprising:

a conical bearing attached to said third gear and to said supporting base and extending therebetween through an opening in said transversible member defining said first axis.

10. The digger according to claim 9, wherein:

said motor has a portion extending through an opening in said transversible member and a motor shaft attached to said second gear, said second and third gears being movable with said transversible member travelling about said second axis as well as rotating.

11. The digger according to claim 10, wherein:

the smaller free end of said conical bearing is attached to said third gear.

12. The digger according to claim 4, wherein:

said first, second and third gears have parallel axes and are arranged substantially coplanar.

13. The digger according to claim 12, further comprising:

a conical bearing attached to said third gear and to said supporting base and extending therebetween through an opening in said transversible member defining said first axis.

14. The digger according to claim 13, wherein:

said motor has a portion extending through an opening in said transversible member and a motor shaft attached to said second gear, said second and third gears being movable with said transversible member travelling about said second axis as well as rotating.

15. The digger according to claim 14, wherein:

the smaller free end of said conical bearing is attached to said third gear.

16. The digger according to claim 1, wherein:

said transversible member and said stage constitute cooperating parts, one of said parts includes a circular guide rail defining an origin at said second axis, and the other of said parts includes a bearing displaceably engaging said guide rail.

17. The digger according to claim 4, wherein:

said transversible member and said stage constitute cooperating parts, one of said parts includes a circular guide rail defining an origin at said second axis, and the other of said parts includes a bearing displaceably engaging said guide rail, the center of said first gear constitutes said origin of said circular guide rail and said second axis, and the center of said third gear constitutes said first axis.

18. The digger according to claim 7, wherein:

said transversible member and said stage constitute cooperating parts, one of said parts includes a circular guide rail defining an origin at said second axis, and the other of said parts includes a bearing displaceably engaging said guide rail, the center of said first gear constitutes said origin of said circular guide rail and said second axis, and the center of said third gear constitutes said first axis.

19. A digger claimed in claim 1 further comprising a drive motor in which an oil-pressure operable piston-cylinder assembly is displaced to the driving motor.

20. A digger comprising:

a carrier having a stage thereon and supporting wheels and trestles, a transversible member angularly movably mounted on said stage, a supporting base angularly movably mounted on said transversible member, a digging-up mechanism including a bucket crane operatively supported on said supporting base, and turning means cooperating with said supporting base for causing said digging-up mechanism to rotatably traverse an oval path upon angular movement of said transversible member, the width of the oval path being transverse to the longitudinal direction of said digger.

* * * * *